US007938520B2

(12) United States Patent
Endo et al.

(10) Patent No.: US 7,938,520 B2
(45) Date of Patent: May 10, 2011

(54) INK-JET RECORDING APPARATUS

(75) Inventors: Akira Endo, Obu (JP); Masashi Tsuda, Ichinomiya (JP); Kazuma Goto, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 1191 days.

(21) Appl. No.: 11/538,121

(22) Filed: Oct. 3, 2006

(65) Prior Publication Data

US 2007/0081059 A1 Apr. 12, 2007

(30) Foreign Application Priority Data

Oct. 7, 2005 (JP) ..... 2005-294953

(51) Int. Cl.
*B41J 2/175* (2006.01)

(52) U.S. Cl. ..... 347/85; 347/93; 347/95

(58) Field of Classification Search ..... 347/100, 347/95, 84, 85, 86, 29; 106/31.27, 31.6, 106/31.13; 523/160
See application file for complete search history.

(56) References Cited

U.S. PATENT DOCUMENTS

| | | | | |
|---|---|---|---|---|
| 5,916,732 | A | 6/1999 | Sasashita et al. | |
| 2005/0057603 | A1 | 3/2005 | Hirakata et al. | |
| 2005/0116984 | A1 * | 6/2005 | Tsuda et al. | 347/20 |
| 2007/0064046 | A1 * | 3/2007 | Goto et al. | 347/29 |

FOREIGN PATENT DOCUMENTS

| | | |
|---|---|---|
| JP | HEI 07-333845 | 12/1995 |
| JP | 2002-292885 | 10/2002 |
| JP | 2003-327711 | 11/2003 |
| JP | 2005-035117 | 2/2005 |
| JP | 2005119288 | 5/2005 |

OTHER PUBLICATIONS

Notice of Reasons for Rejection (Office Action) in Japanese counterpart application No. 2005-294953 from the Japanese Patent Office on Sep. 8, 2010, along with a partial English translation of the Notice.

* cited by examiner

*Primary Examiner* — Manish S Shah
(74) *Attorney, Agent, or Firm* — Banner & Witcoff, Ltd.

(57) ABSTRACT

An ink-jet recording apparatus includes a rubber member in an ink flow passage. The rubber member is pretreated with an organic solvent having a high boiling point, a water-based liquid containing a coloring agent, or a mixture of the two. The pretreatment is effective for preventing additives in the rubber material from being eluted into a water-based liquid for ink-jet recording, which can lead to clogging of ink-jet nozzles and the like.

10 Claims, No Drawings

INK-JET RECORDING APPARATUS

CROSS REFERENCE TO RELATED APPLICATION

This application claims priority to Japanese Patent Application No. 2005-294953, filed Oct. 7, 2005, the entire disclosure of which is hereby incorporated by reference.

BACKGROUND

An ink-jet recording apparatus functions by allowing ink to adhere to a recording material, such as recording paper, by means of an ink discharge method. One example is a thermal method, which generates bubbles and pressure by rapid heating, and then discharges fine droplets of the ink from a fine nozzle. Another example is a piezoelectric method, which discharges fine droplets of ink using a piezoelectric element.

In an ink-jet recording apparatus, rubber members usually are used in ink flow passages containing an ink tank or an ink-jet head. Common examples of such rubber members include a cap for covering an ink-jet head nozzle, a wiper for cleaning an end face of an ink-jet head nozzle, a seal packing to be pinched between parts at a juncture, and a tube for supplying the ink from the ink tank to an ink-jet head. The rubber members usually contain one or more additives, such as a vulcanization agent such as zinc oxide, sulfur, and the like; a vulcanization accelerator such as tetramethyl thiuram disulfide, zinc dithiocarbamate, zinc diethyl dithiocarbamate, and the like; a lubricant; and a softening agent.

When conventional rubber members come into contact with the ink used in the ink-jet recording (hereinafter, referred to also as "ink") or a preservative solution filled in the ink flow passage at the time of shipping or storage, the additives contained in the rubber member can be eluted into the ink or the preservative solution. The eluted additive can be deposited as insoluble matter, thereby causing clogging of the nozzle of the ink-jet head or the like.

One effort to address this problem is disclosed in U.S. Publication No. 2005/0116984 A1, which provides a method in which the rubber member is dipped in water at 60° C. in a hermetically-sealed container for a predetermined period of time. The amount of eluted material is measured, so that rubber materials that elute lower amounts of insoluble matter can be identified.

The type or amount of insoluble matter eluted into ink or preservative solution may vary depending on such factors as the composition of the ink or preservative solution.

Even when a rubber material selected by the method described in U.S. Publication No. 2005/0116984 A1 is used in the rubber member, insoluble matter still may be eluted from the rubber member. This can happen, for example, due to the presence of an organic solvent having a relatively high boiling point or a coloring agent in the ink or the preservative solution. Such components may be eluted into the ink or the preservative solution in actual ink-jet recording devices despite not having been eluted under the test conditions described in U.S. Publication No. 2005/0116984 A1.

SUMMARY

Aspects of the invention are directed to an ink-jet recording apparatus having a rubber member in an ink flow passage. The rubber member can be pretreated with an organic solvent having a high boiling point, a water-based liquid containing a coloring agent, or a mixture of the two. The pretreatment is effective for preventing additives in the rubber material from being eluted into a water-based liquid for ink-jet recording, which can lead to clogging of ink-jet nozzles and the like.

DETAILED DESCRIPTION

General Overview

Aspects of the invention include an ink-jet recording apparatus having a rubber member in one or more ink flow passages. The rubber member can be pretreated to prevent or minimize elution of insoluble matter when the rubber member is contacted with a water-based liquid for ink-jet recording. As used herein, "water-based liquid for ink-jet recording" refers to an ink used in ink-jet recording, a preservative solution filled in ink flow passages at the time of shipping or storage, or the like. In one aspect, the rubber member is pretreated with an organic solvent having a high boiling point, a water-based liquid containing a coloring agent, or a mixture of the two (hereinafter, sometimes referred to as "pretreatment liquid").

An ink-jet recording apparatus includes at least one rubber member which has been subjected to a pretreatment with the organic solvent and/or the water-based liquid containing a coloring agent. The rubber member can be used in at least a portion of the ink flow passage which comes in contact with a water-based liquid for ink-jet recording. The pretreatment is effective for suppressing elution or precipitation of additives contained in the rubber member, thus avoiding clogging in the ink-jet head nozzle and enhancing discharge stability of the water-based liquid for ink-jet recording. While not wanting to be bound by theory, it is believed that the pretreatment liquid fills small cavities present at the surface of the rubber member, thereby preventing the water-based liquid for ink-jet recording from entering into these small cavities.

Illustrative Aspects of the Invention

According to aspects of the invention, an ink-jet recording apparatus has a rubber member in at least a portion of an ink flow passage that comes in contact with a water-based liquid for ink-jet recording. The rubber member can be pretreated with an organic solvent having a high boiling point, a water-based liquid having a coloring agent, or a mixture of the two. Other components of the ink-jet recording apparatus can be of conventional construction. There is no limitation on ink discharge methods. A thermal method, a piezoelectric method, or any other method can be used.

Non-limiting examples of rubber members used in the ink flow passage include a cap for covering a nozzle of an ink-jet head, a wiper for cleaning an end face of the nozzle, a tube which supplies the water-based liquid for ink-jet recording from an ink tank to the ink-jet head, and a seal packing which is an elastic member to be pinched between a buffer tank and a head unit as disclosed in the specification in Japanese Patent Application No. 2004-207208.

The rubber member generally includes at least one rubber base polymer, examples of which include ethylene-propylene diene rubber polymer (EPDM) and isobutylene-isoprene rubber polymer (IIR). An ethylene-propylene diene rubber polymer represented by the following formula is preferred from the standpoint of exhibiting a sliding property:

$$-(CH_2CH_2)_l-(CH_2\overset{\overset{CH_3}{|}}{C}H)_m-(X)_n-$$

wherein X represents a nonconjugated diene compound such as ethylydene norbornene, dicyclopentadiene, 1,4-hexadiene, and the like.

As for such rubber base polymers, commercially available products can be used. Examples of ethylene-propylene diene rubber polymers include EP331 (JSR Corporation), ESPRENE 505® (Sumitomo Chemical Co., Ltd.), and the like. Examples of isobutylene-isoprene rubber polymers include HT-1066® and HT-1068® (JSR Corporation), and the like.

Non-limiting examples of additives commonly compounded in the rubber members include organic peroxides such as diacyl peroxide, dialkyl peroxide, peroxyester, peroxyketal, and the like; vulcanization agents such as zinc oxide and the like; vulcanization accelerators such as tetramethylthiuram disulfide, zinc dithiocarbamate and the like; lubricants such as calcium stearate, stearic amide, magnesium oxide and the like; fillers such as carbon black, calcium carbonate, silicon dioxide and the like; softening agents such as paraffin wax and the like; antioxidants; antiscorching agents; and the like.

The rubber member can be prepared by kneading the components using, for example, a banbury mixer, a kneader, or a pair of rolls. The resultant article then can be subjected to a rubber heat-forming treatment, ordinarily at from about 140 to about 200° C. for a period of from about 5 to about 15 minutes. When an ethylene-propylene diene rubber polymer or the like is used as the rubber base polymer, a heat-forming treatment is usually performed at from about 160 to about 180° C. for a period of from about 5 to about 13 minutes, and then a heating treatment at from about 100 to about 150° C. for a period of from about 1 to about 24 hours. By these treatments, unreacted organic peroxide and the like can be removed, thereby slightly increasing hardness. When the heating treatment is performed at unduly high temperatures and/or for too a long period of time, the rubber can be unfavorably scorched.

From the standpoint of preventing an aggregate from forming when a water-based liquid for ink-jet recording is present in the ink-jet recording apparatus, the organic solvent and/or coloring agent used in the pretreatment liquid can be selected to be the same as those used in the water based-liquid for ink-jet recording.

Organic solvents that can be used in the pretreatment liquid usually have a boiling point at atmospheric pressure of about 170 ° C. or more. Polyhydric alcohols, such as a glycol, have favorable properties such as molecular weight and capability of forming hydrogen bonds. Non-limiting examples of polyhydric alcohols include, but are not limited to, glycerin (boiling point: 290° C.), diethylene glycol (boiling point: 245° C.), propylene glycol (boiling point: 188.2° C.), dipropylene glycol (boiling point: 232° C.), 1,3-butylene glycol (boiling point: 207.5° C.), 1,4-butylene glycol (boiling point: 228° C.), polyethylene glycol having a molecular weight of from about 190 to about 630 (boiling point: 250° C.), and the like. These glycols can be used in combination of two types or more. The organic solvent may be mixed with water to adjust the viscosity, if needed. The amount of water added, if any, ordinarily should not be more than about 30 wt %; otherwise, the effect of the pretreatment liquid may be inhibited. Any water added should be of a high purity, such as ion-exchanged water, distilled water, ultra-pure water, or the like.

The pretreatment liquid may also contain a coloring agent, usually in the form of a water-based liquid containing a coloring agent. For example, the coloring agent may be an aqueous solution of an acid dye, a direct dye, or a combination thereof. Non-limiting examples of coloring agents include C. I. Acid Yellow 23, C. I. Acid Red 52, C. I. Acid Red 289, C. I. Acid Blue 9, C. I. Direct Yellow 86, C. I. Direct Yellow 132, C. I. Direct Violet 107, C. I. Direct Blue 199, and the like. In order to prevent the nozzle, the filter, and the like from being clogged due to impurities contained in water, high purity water can be used, such as ion-exchanged water, distilled water, ultra-pure water, and the like. Although a pigment may be present, it should be noted that pigments can create a risk of generating aggregates or precipitation. The concentration of the coloring agent in the water-based liquid usually ranges from about 3 to about 10 wt %, often from about 4 to about 8 wt %.

When the pretreatment liquid includes both an organic solvent and a coloring agent, the concentration of the organic solvent should not be excessively high. Otherwise, the coloring agent may not be fully dissolved. Ordinarily the concentration of the organic solvent should not exceed about 60 wt % of the total weight of the pretreatment liquid.

Pretreatment of the rubber member can be carried out using any suitable technique, such as dipping the rubber member in the pretreatment liquid while heating in an reduced-pressure vessel, e.g., having a pressure of from about 80,000 to about 100,000 Pa, often from about 90,000 to about 100,000 Pa. Excessively high temperatures can result in a risk of decomposing the pretreatment liquid. Unduly low temperatures can present a risk of decreasing penetrability of the pretreatment liquid into the rubber member. Usually, the temperature ranges from about 40 to about 70° C., often from about 50 to about 60° C. The pretreatment ordinarily is performed for a period of from about 50 to about 70 hours.

Another example of a pretreatment technique, involves placing the rubber member in a reduced-pressure vessel, for example one having a pressure of from about 80,000 to about 100,000 Pa, often from about 90,000 to about 100,000 Pa. While under a reduced-pressure state, the rubber member can be dipped in the pretreatment liquid and heated. Usually, the temperature is from about 40 to about 70° C., often from about 50 to about 60° C. The pretreatment is ordinarily performed for a period of from about 50 to about 70 hours. In this pretreatment, after the rubber member is dipped in the pretreatment liquid under a reduced-pressure state, the pretreatment liquid may be heated under an atmospheric pressure or an increased pressure of from about 100,000 to about 300,000 Pa. This procedure is particularly effective for treating the inner wall of the small cavities at the surface of the rubber member.

EXAMPLES 1 TO 40 AND COMPARATIVE EXAMPLE 1 TO 4

(1) Preparation of Testing Samples

Individual components were sequentially loaded in a rubber mixer in accordance with a composition shown in Table 1, kneaded and discharged. The resultant article was extruded in a sheet state by using a twin screw extruder and subjected to a vulcanize-forming treatment (170° C. for 10 minutes), to thereby obtain rubber sheets (EPDM, IIR) each having a thickness of 2 mm. The thus-obtained rubber sheets were cut in rectangles each having sizes of 50 mm length and 10 mm width to thereby prepare testing samples of rubber members.

TABLE 1

| Component | | (unit: part by weight) EPDM | IIR |
|---|---|---|---|
| Polymer | Ethylene propylene diene rubber polymer (EP331; JSR Corporation) | 100 | — |
| | Isoprene isobutylene rubber polymer (HT-1066; JSR Corporation) | — | 100 |
| Vulcanization agent | Zinc oxide | 5 | 5 |
| | Sulfur | 1.5 | — |
| Vulcanization accelerator | Zinc diethyl dithiocarbamate | 1.5 | 1.5 |
| Filler | Carbon black | 80 | 50 |
| Softening agent | Paraffin oil | 30 | 30 |
| Lubricant | Calcium stearate | 1 | 1 |

(2) Preparation of Water-based Ink for Ink-jet Recording for Evaluation

By stir-mixing individual components shown in Table 2, a water-based ink for ink-jet recording for evaluation was obtained.

TABLE 2

| Component | wt % |
|---|---|
| Self-dispersing type carbon black (CAB-O-JET ® 300; Cabot Corp.) | 30 |
| Glycerin | 17 |
| Triethylene glycol-n-butyl ether | 4.5 |
| OLFINE ® E1010 (Acetylene glycol type surfactant; Nisshin Chemical Industry Co., Ltd.) | 0.2 |
| Proxel XL-2(S) (Midewproofing agent; Arch Chemicals, Inc.) | 0.2 |
| Water | balance |

(3) Pretreatment of Testing Samples

Testing samples of the rubber members were dipped in pretreatment liquids shown in Table 3 (organic solvent: glycol or aqueous glycol solution), Table 4 (colored aqueous solution: aqueous dye solution), Table 5 (colored mixed liquid: aqueous solution of glycerin and dye) or Table 6 (Comparative Example), and then subjected to heating processing with a pressure reduction degree of 100,000 Pa at 60° C. for 3 days. Then, testing samples were taken out of the pretreatment liquids, and subsequently an excess amount of the pretreatment liquid attached on each of surfaces thereof was wiped out with KIMWIPE S-200® (Crecia Corporation).

(4) Evaluation of Insoluble Compounds from Rubber Member

One sheet of testing samples subjected to pretreatment was dipped in a water-based ink for ink-jet recording for evaluation and was left to stand in a thermostatic oven for two weeks at 60° C. Thereafter, the thus-dipped rubber sample was taken up and the remaining water-based ink was filtered by using an electroformed filter (pore diameter of 13 μm; effective filtering area of 8 $cm^2$) to measure a time ($T^1$) required for filtering. Further, for comparison, the water-based ink in which the rubber sample was not dipped was left to stand under same conditions (two weeks at 60° C.), filtered by using an electroformed filter having same specifications to measure a time ($T^0$: reference time) required for filtering. Then, a ratio (%) of $T^1$ to $T^0$ was determined, and then evaluated in accordance with the following criteria:

AA: Filtering time of less than 130% of the reference time was required

A: Filtering time of from 130% to less than 200% of the reference time was required B: Filtering time of from 200% to less than 400% of the reference time was required C: Filtering time of 400% or more of the reference time was required.

Test results are shown in Tables 3 to 6. Upon examining the electroformed filter used in filtering, it was found that as the ratio of filtering time to reference time increased, the amount of insoluble compounds also increased.

TABLE 3

| | Rubber member | Pretreatment liquid | Evaluation |
|---|---|---|---|
| Example 1 | EPDM | Glycerin:water = 85:15 *1 | AA |
| Example 2 | | Diethylene glycol | AA |
| Example 3 | | Propylene glycol | A |
| Example 4 | | Dipropylene glycol | AA |
| Example 5 | | 1,3-butylene glycol | A |
| Example 6 | | 1,4-butylene glycol | A |
| Example 7 | | PEG200 | AA |
| Example 8 | | PEG300 | A |
| Example 9 | | PEG400 | A |
| Example 10 | | PEG600:water = 90:10 *1 | A |
| Example 11 | IIR | Glycerin:water = 85:15 *1 | AA |
| Example 12 | | Diethylene glycol | A |
| Example 13 | | Propylene glycol | A |
| Example 14 | | Dipropylene glycol | AA |
| Example 15 | | 1,3-butylene glycol | A |
| Example 16 | | 1,4-butylene glycol | A |
| Example 17 | | PEG200 | A |
| Example 18 | | PEG300 | A |
| Example 19 | | PEG400 | A |
| Example 20 | | PEG600:water = 90:10 *1 | A |

PEG200: polyethylene glycol 200; average molecular weight = 190 to 200
PEG300: polyethylene glycol 300; average molecular weight = 285 to 315
PEG400: polyethylene glycol 400; average molecular weight = 380 to 420
PEG600: polyethylene glycol 600; average molecular weight = 570 to 630
*1 shows mixed ratio (weight basis) of pretreatment liquid

TABLE 4

| | Rubber member | Pretreatment liquid | Evaluation |
|---|---|---|---|
| Example 21 | EPDM | 5 wt % aqueous solution of C.I. Acid Yellow 23 | A |
| Example 22 | | 5 wt % aqueous solution of C.I. Acid Red 52 | A |
| Example 23 | | 5 wt % aqueous solution of C.I. Acid Red 289 | AA |
| Example 24 | | 5 wt % aqueous solution of C.I. Acid Blue 9 | AA |
| Example 25 | | 5 wt % aqueous solution of C.I. Direct Yellow 86 | AA |
| Example 26 | | 5 wt % aqueous solution of C.I. Direct Yellow 132 | A |
| Example 27 | | 5 wt % aqueous solution of C.I. Direct Violet 107 | A |
| Example 28 | | 5 wt % aqueous solution of C.I. Direct Blue 199 | A |
| Example 29 | IIR | 5 wt % aqueous solution of C.I. Acid Yellow 23 | AA |
| Example 30 | | 5 wt % aqueous solution of C.I. Acid Red 52 | A |
| Example 31 | | 5 wt % aqueous solution of C.I. Acid Red 289 | AA |
| Example 32 | | 5 wt % aqueous solution of C.I. Acid Blue 9 | A |
| Example 33 | | 5 wt % aqueous solution of C.I. Direct Yellow 86 | AA |
| Example 34 | | 5 wt % aqueous solution of C.I. Direct Yellow 132 | A |
| Example 35 | | 5 wt % aqueous solution of C.I. Direct Violet 107 | A |
| Example 36 | | 5 wt % aqueous solution of C.I. Direct Blue 199 | A |

TABLE 5

| | Rubber member | Pretreatment liquid *1 | Evaluation |
|---|---|---|---|
| Example 37 | EPDM | PEG200:C.I. Acid Yellow 23:water = 35:5:60 | AA |
| Example 38 | | Glycerin:C.I. Direct Yellow 132:water = 30:5:65 | AA |
| Example 39 | IIR | PEG200:C.I. Acid Yellow 23:water = 35:5:60 | AA |
| Example 40 | | Glycerin:C.I. Direct Yellow 132:water = 30:5:65 | AA |

PEG200: polyethylene glycol 200; average molecular weight = 190 to 200
*1 shows mixed ratio (weight basis) of pretreatment liquid

TABLE 6

| | Rubber member | Pretreatment liquid | Evaluation |
|---|---|---|---|
| Comparative Example 1 | EPDM | — *2 | C |
| Comparative Example 2 | | Water | C |
| Comparative Example 3 | IIR | — *2 | C |
| Comparative Example 4 | | Water | C |

*2 No pretreatment is performed

As evident from Tables 3-6, rubber members that were subjected to pretreatment with an organic solvent having a high boiling point, an aqueous dye solution, or a mixture of the two, generated extremely small amounts of insoluble compounds when contacted with water-based ink for ink-jet recording. On the other hand, rubber members of Comparative Examples 1 to 4, which were subjected to pretreatment or subjected to pretreatment with only water, generated greater amounts of insoluble compounds.

(5) Evaluation of Continuous Printing with Actual Apparatus

A nozzle cap and a wiper part were produced with EPDM and IIR shown in Table 1 were subjected to the pretreatments denoted in Examples 38 and 40. These rubber members were thereafter attached to a digital multifunction machine mounted with an ink-jet printer (MFC-5100J; Brother Industries, Ltd.) and subsequently subjected to continuous printing evaluation of 200 million dots, inclusive of a wiping operation and a capping operation. At the point of completion of 200 million dots, printing failure did not occur. On the other hand, when the cap and the wiper parts were not subjected to the pretreatment (Comparative Examples 1 and 3), printing failure occurred at the point of completion of continuous printing of 100 million dots. The eluted material was attached to the cap and the head, which caused printing failure. When the eluted material was identified by using an FT-IR, it was found to be a vulcanization accelerator.

The invention is not limited to the aspects described in the Examples, which are provided for illustrative purposes only. It will be apparent that various modifications can be made without departing from the spirit and the scope of the invention as described and claimed herein.

What is claimed is:

1. A method of substantially preventing elution of insoluble compounds when a rubber member in an ink flow passage of ink-jet recording apparatus is contacted with a water-based liquid for ink-jet recording, the method comprising pretreating the rubber member in a reduced pressure with a pretreatment liquid comprising at least one of an organic solvent having a high boiling point and a water-based liquid containing a coloring agent, wherein the pretreatment comprises the steps of dipping the rubber member in the pretreatment liquid and, while dipped in the pretreatment liquid, heating to a temperature of from about 40 to about 70° C. in a reduced-pressure vessel having a pressure of from about 80,000 to about 100,000 Pa.

2. The method of claim 1, wherein the organic solvent having a high boiling point is selected to be the same as an organic solvent used in the water-based liquid for ink-jet recording.

3. The method of claim 1, wherein the coloring agent is selected to be the same as a coloring agent used in the water-based liquid for ink-jet recording.

4. The method of claim 1, wherein the water-based liquid for ink-jet recording is ink.

5. The method of claim 1, wherein the water-based liquid for ink-jet recording is a preservative solution.

6. A method of, substantially preventing elution of insoluble compounds when a rubber member in an ink flow passage of ink-jet recording apparatus is contacted with a water-based liquid for ink-jet recording, the method comprising pretreating the rubber member in a reduced pressure with a pretreatment liquid comprising at least one of an organic solvent having a high boiling point and a water-based liquid containing a coloring agent, wherein pretreatment comprises the steps of placing the rubber member in a reduced-pressure vessel having a pressure of from about 80,000 to about 100,000 Pa; while in the reduced-pressure vessel dipping the rubber member in the pretreatment liquid; and then heating the rubber member to a temperature of from about 40 to about 70° C. under atmospheric pressure or increased pressure.

7. The method of claim 6, wherein the organic solvent having a high boiling point is selected to be the same as an organic solvent used in the water-based liquid for ink-jet recording.

8. The method of claim 6, wherein the coloring agent is selected to be the same as a coloring agent used in the water-based liquid for ink-jet recording.

9. The method of claim 6, wherein the water-based liquid for ink-jet recording is ink.

10. The method of claim 6, wherein the water-based liquid for ink-jet recording is a preservative solution.

* * * * *